US006935856B2

(12) United States Patent
Le Goueffec et al.

(10) Patent No.: US 6,935,856 B2
(45) Date of Patent: Aug. 30, 2005

(54) METHOD OF IMPROVING THE TEMPERATURE PROFILE OF A FURNACE

(75) Inventors: Gérard Le Goueffec, Velizy (FR); Olivier Delabroy, Paris (FR)

(73) Assignee: L'Air Liquide, Société Anonyme à Directoire et Conseil de Surveillance pour l'Etude et l'Exploitation des Procédés Georges Claude, Paris (FR)

( * ) Notice: Subject to any disclaimer, the term of this patent is extended or adjusted under 35 U.S.C. 154(b) by 0 days.

(21) Appl. No.: 10/489,083

(22) PCT Filed: Aug. 23, 2002

(86) PCT No.: PCT/FR02/02931

§ 371 (c)(1),
(2), (4) Date: Aug. 9, 2004

(87) PCT Pub. No.: WO03/021174

PCT Pub. Date: Mar. 13, 2003

(65) Prior Publication Data

US 2004/0259047 A1 Dec. 23, 2004

(30) Foreign Application Priority Data

Sep. 6, 2001 (FR) ..... 01 11537

(51) Int. Cl.[7] ..... F27B 9/00
(52) U.S. Cl. ..... 432/11; 432/128; 432/133
(58) Field of Search ..... 432/179, 174, 432/175, 180, 28, 128, 133, 11

(56) References Cited

U.S. PATENT DOCUMENTS

| | | | | | |
|---|---|---|---|---|---|
| 4,087,238 | A | * | 5/1978 | Seigel | 432/18 |
| 4,257,767 | A | * | 3/1981 | Price | 432/24 |
| 4,338,077 | A | * | 7/1982 | Shibayama et al. | 432/11 |
| 4,357,135 | A | * | 11/1982 | Wilde et al. | 432/11 |
| 4,427,371 | A | * | 1/1984 | Unks | 432/11 |
| 4,884,969 | A | * | 12/1989 | Kolln Bernd et al. | 432/133 |
| 6,290,492 | B1 | * | 9/2001 | Li et al. | 432/14 |

FOREIGN PATENT DOCUMENTS

| | | |
|---|---|---|
| EP | 0 370 916 | 5/1990 |
| WO | WO 90 06379 | 6/1990 |

* cited by examiner

*Primary Examiner*—Gregory A. Wilson
(74) *Attorney, Agent, or Firm*—Linda K. Russell

(57) ABSTRACT

A furnace apparatus and method for increasing the productivity and/or quality of reheated products by improving the temperature profile of a furnace for reheating products.

23 Claims, 2 Drawing Sheets

O2
AIR
900°C-1100°C
900°C-1000°C
900°C-1000°C
1200°C-1400°C
RECUPERATOR
HOT AIR

METHOD OF IMPROVING THE TEMPERATURE PROFILE OF A FURNACE

BACKGROUND OF THE INVENTION

1. Field of the Invention

The present invention relates to a method of improving the temperature profile of a furnace, and especially the temperature profile of a furnace for reheating or annealing products, more particularly steel products such as slabs or billets or flat products.

2. Related Art

Reheat and/or heat-soak furnaces are generally used in the steel industry, especially in continuous casting cycles in which liquid metal is cast to form intermediate products which, before they pass into the rolling mill at the end of the continuous casting line, pass through at least one furnace called a reheat furnace in which the intermediate product is brought to or soaked at a suitable temperature, which is as uniform as possible, so as to be subsequently rolled under optimum conditions.

A reheat furnace of this type and its method of use is described, for example, in EP-A-0 370 916.

In a reheat furnace, there is generally at least one zone equipped with heating means, for example burners, so as to provide the energy necessary for reheating or heat-soaking the metallurgical products. Three main zones are often distinguished in a furnace, especially a reheat furnace, these being characterized by different heat transfer modes:

- the actual heating or firing zone where combustion develops (with burners, plasmas, auxiliary heating, etc.), in which the ambient temperature or the temperature of the product is controlled and if necessary regulated. This zone is characterized by the fact that the heat is produced in situ, this produced heat being a direct means of controlling and/or regulating the temperature in this zone;
- the flue gas exhaust zone, also called the dead zone, in which the flue gases or the atmosphere coming from the heating zone lose some of their energy to the steel product entering the furnace. This zone helps to optimize the thermal efficiency of the process; and
- the so-called heat recovery zone, comprising a heat recovery system that allows some of the energy still present in the flue gases or in the atmosphere leaving the furnace to be transferred to the oxidizer needed for combustion (oxidizer preheating). By recycling, this energy is reintroduced into the furnace, which optimizes even further the overall energy budget.

External limitations aside, current regulation systems make it possible to operate the heating zone and the recuperator at their nominal running conditions by simply controlling various direct parameters (burner power, auxiliary energy, heat exchange in the recuperator, etc.) to regulate these zones.

In contrast, the dead zone of a furnace is not regulated as the heat exchange is completely dependent on the operating parameters of the heating zone and, where relevant, of the recuperator. In particular, the thermal profiles in said zone are not optimized as they depend on the materials flow conditions (the materials being the flue gases and the metallurgical products) in the furnace and on their temperature conditions.

The sole constraint that is generally imposed by the furnace operator is the "exhaustion" of the flue gases (optimum heat exchange between the flue gases and the products or the furnace) in this zone so as to comply with the limitation on the temperature at which the flue gases leave this zone so as not to damage the flue gas recovery system and limit the heat losses by the flue gases if they are not recovered.

In the construction of the furnace, this zone is therefore designed to provide sufficient cooling of the flue gases output by the heating zone.

FIG. 1 explains better the operation of a reheat furnace of known type and the problems to be solved in order to improve its operation.

In FIG. 1, the reheat furnace 1 is shown schematically with the metallurgical products 5 moving forward (thanks to a system of beams 14 and drive means, these not being shown in FIG. 1) from right to left, the direction of advance of these products being indicated by the arrows 7.

The furnace 1 comprises here a heating zone 2 in which the temperature varies between 1200° C. and 1400° C., this zone 2 being fitted with burners and having one or more regulating zones. The burners are not shown in this figure. Only the hot air circuit is schematically indicated (13). The furnace also includes a dead zone 3, which is generally the preferential flue gas path, in which the flue gas temperature is generally around 900° C. to 1100° C., which is sufficient for effective preheating of the steel products by heat exchange and finally a underheated zone 4 that forms part of the dead zone 3, generally located near the point of entry of the steel products and generally above them (in particular if the flue gas recovery line 8 lies below the point of entry of the steel products) and the temperature of which zone varies between 600° C. and 900° C.—this temperature is generally too low for effective preheating of the steel products.

The flue gases are used to preheat the air (oxidizer), coming from the oxidizer generator 11 via the line 10, in the recuperator 9 from which the preheated oxidizer exits along the line 12 that feeds the burners 13 with oxidizer (the fuel lines for the burners are not shown in FIG. 1).

In such an operating mode, the dead zone 3 is heated little throughout the duration of production and there exists in fact the possibility of having, at least for part of the production time, a higher temperature in this zone so as to preheat the steel product better.

However, this temperature increase in the dead zone must not result in a corresponding increase in the temperature of the flue gases exiting the furnace. This is because, although the temperature of the dead zone (and therefore of the flue gases) can be increased by about 200° C. for example, the problem that arises is that it is undesirable for these flue gases to exit the furnace at a temperature 200° C. higher than their usual exit temperature. The problem is that if there is no recuperator at the furnace exit, then since the flue gas temperature is 200° C. higher, all the corresponding thermal energy is lost and the thermal (and therefore financial) budget of the furnace becomes unacceptable. Likewise, if there is a recuperator (as indicated in FIG. 1), which usually works at a temperature close to its maximum temperature (in other words, the temperature of the flue gases entering the recuperator is close to the maximum temperature that the recuperator can withstand without being damaged), it is not possible to supply it with flue gases whose temperature has been increased by 200° C. Consequently, a person skilled in the art is faced with the problem of substantially increasing the temperature of the dead zone of the furnace, and especially its crown temperature, without a corresponding substantial increase in the temperature of the flue gases exiting the furnace.

SUMMARY OF THE INVENTION

The invention solves the technical problem thus posed. For this purpose; the invention provides for the use of supplementary heating means, placed in the dead zone (3) of the furnace (or having a thermal action on the dead zone of the furnace), without substantial additional flue gas generation, so as in this way to avoid any substantial transfer of energy and especially the energy generated by these supplementary heating means, via the flue gases (and especially the additional flue gases).

BRIEF DESCRIPTION OF THE DRAWINGS

For a further understanding of the nature and objects for the present invention, reference should be made to the following detailed description, taken in conjunction with the accompanying drawings, in which like elements are given the same or analogous reference numbers and wherein.

DESCRIPTION OF PREFERRED EMBODIMENTS

Figure 1:
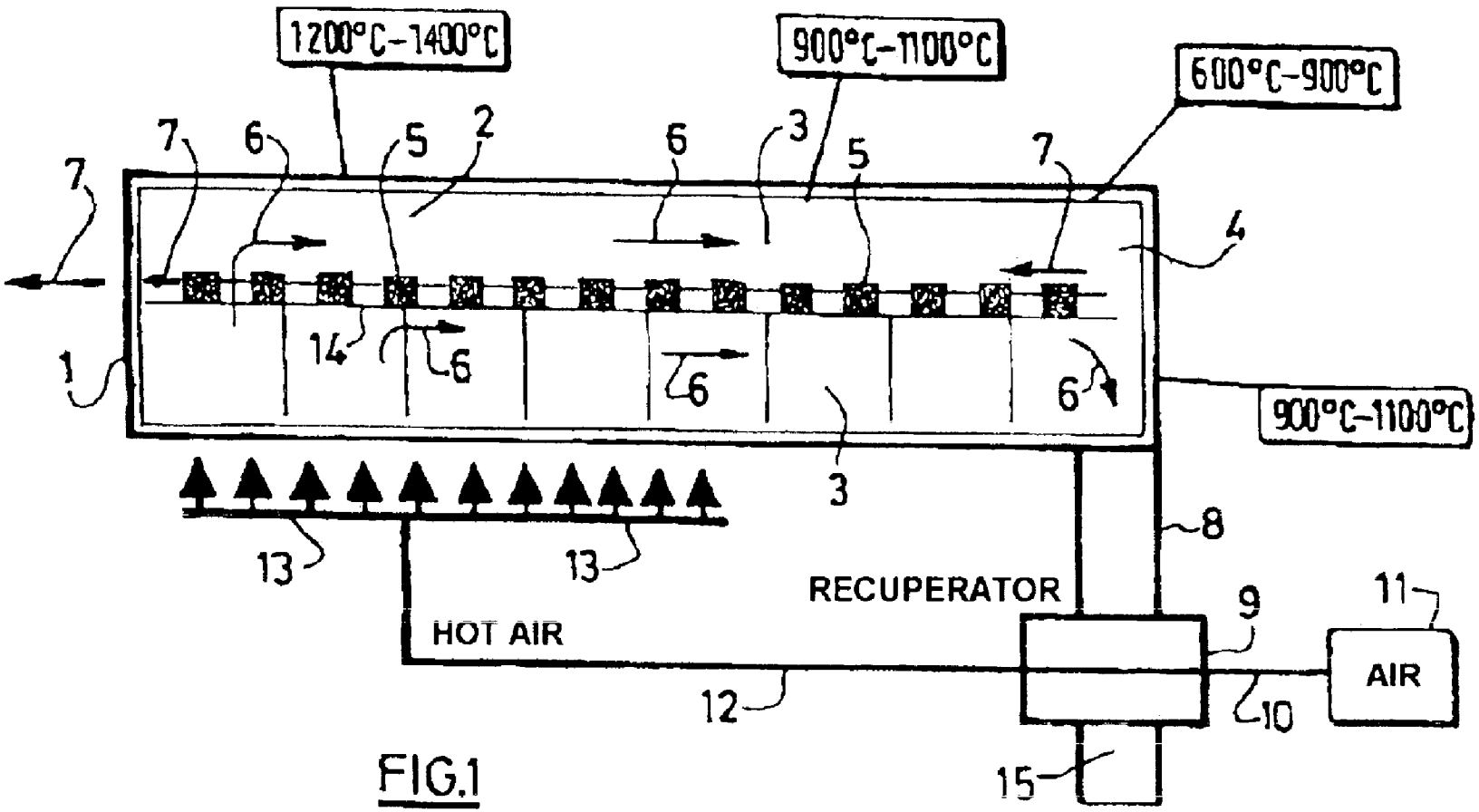
FIG. 1 illustrates the reheat furnace 1 shown schematically with the metallurgical products 5 moving forward from right to left, the direction of advance of these products being indicated by the arrows 7.

The expression "substantial additional flue gas generation" is understood to mean, according to the invention, the generation of at least 10% of additional flue gas by volume relative to the volume of flue gas created in the furnace in the absence of the supplementary heating means.

As a consequence, according to the invention, the supplementary heating means shall be designed so as not to create more than 10% by volume of additional flue gas, and preferably no more than 5% by volume of additional flue gas, relative to the volume of flue gas generated by the other burners of the furnace in the absence of these supplementary heating means (the other burners of the furnace operating in the same way in both cases, for the purpose of comparing flue gas volumes). The energy produced by these supplementary means may represent up to 20% of the total energy supplied (or up to 25% of the initial installed power).

According to the invention, the supplementary heating means will preferably be burners in which the oxidizer for at least one of these burners is enriched with oxygen (more than 21% $O_2$ in oxygen), preferably burners in which the oxidizer contains more than 88 vol % oxygen (for example, oxygen supplied by an air gas separation unit operating by VSA-type adsorption, well known to those skilled in the art) and more preferably industrially pure oxygen, comprising more than 95% oxygen by volume, the balance preferably being essentially argon and nitrogen. The oxidizer may contain 1% to 10% argon by volume and/or 0.1 to 10% nitrogen by volume. Of course, an oxidizer containing 100% oxygen is perfectly suitable.

Heating means other than oxygen-based burners may be suitable, especially those that generate no additional flue gas, such as radiant panels (electrical resistance heating elements), radiant burners or regenerative-type burners which in practice generate only very little additional flue gas in the normal flue gas circuit as they are designed to take in the external air, preheat it by heat exchange with an equivalent volume of flue gas, itself also taken into the furnace, and discharge the flue gases from the furnace into a specific flue gas circuit after thermal "exhaustion" thereof and use of the air thus preheated as (at least part of) the oxidizer in the burner.

The supplementary heating means will generally be placed in the dead zone, away from the flue gas discharge duct leading to the recuperator (if such a recuperator is present). Since the flue gases are often discharged at the bottom of the furnace, the supplementary heating means will therefore be preferably placed in the upper part (near the crown) of the furnace. However, the reverse situation remains possible.

Various arrangements of these additional heating means are possible. For example, one or more burners (or the equivalent) in the wall 20 (FIG. 2) of the furnace, just above the zone of entry of the products into the furnace, or else one or more burners in a through-block (or recess) 21 (FIG. 2) placed in the crown or in the end charging wall 22, preferably at the "downstream" limit of the dead zone (in the direction in which the product runs) with flames directed either toward the point of entry of the product into the furnace (in the direction in which the flue gases flow) or toward the point where the products exit the furnace (as a countercurrent with the flue gases) or a combination of the two, or else one or more burners in at least one of the side walls of the furnace, level with the products, in the dead zone, or else a combination of these various options.

As regards the fitting of the supplementary heating means according to the invention in a furnace, there are generally three different situations that may be distinguished, especially in the case of reheat furnaces.

In the first situation, the power delivered by the burners in the heating zone is high and the maximum crown temperature limit of the furnace is reached, while the flue gases are discharged from the furnace after passing through the dead zone at a temperature that is quite far from the maximum temperature at which the flue gases enter the recuperator. In this type of configuration, it is not possible to heat more, upstream (in the heating zone), with existing burners, even if the temperatures of the walls and crown of the furnace in the dead zone are too low to preheat the steel products properly.

In the second situation, unlike the first, the flue gas temperature at the exit of the dead zone is a maximum, while the crown temperature in the heating zone is markedly less than the maximum temperature that this crown can withstand. In this situation, the power in the heating zone can be increased but only at the risk of damaging the crown in the dead zone and/or the recuperator.

Finally, in the third situation, neither the temperature in the heating zone nor the temperature of the flue gases in the dead zone reach their maximum value, which results in crown temperatures below the maximum values both in the heating zone and in the dead zone.

The present invention consists in using a supplementary heating means that allows the heat transfer to the product in the dead zone to be increased without causing a substantial energy transfer to the furnace near the point of discharge of the flue gases. For this purpose, the additional heating means makes it possible in particular to raise all or part of the dead zone to its maximum permissible temperature $T_{max}$(crown), this temperature generally depending on the geometry and the components that make up the furnace, the choice of additional heating means and of the velocity, especially the flow velocity, of the flue gases being such that the temperature of said flue gases does not exceed the maximum permissible temperature $T_{max}$(flue gas).

This temperature reprofiling will provide the maximum possible heat transfer in this portion of the furnace.

In the spaces where the temperature is markedly below the actual limitations of the plant or the acceptable heat loss limits, the heat transfer to the products is very substantially less than the potential (virtual absence of radiative transfer and little convective transfer).

The maximum temperature limit at the recuperator is generally around 900° C. According to another aspect of the invention, it is therefore necessary to control the furnace exit temperature of the flue gases so as to keep this temperature below the limit value (for example 900° C. in the above example), for example by regulating the supplementary heating means by measuring the furnace exit temperature of the flue gases.

In practice, by implementing the invention described above it has been found that the total power delivered in the furnace is 5 to 20% higher than the initial power. The furnace entry temperature profile is higher (900° C. to 1200° C.), especially in the zones previously very little utilized (600° C.–900° C.). The increase in production created is between 5% and 25%, depending on the installed power levels. The energy loss under these conditions remains less than 5%.

In addition to the increase in production and/or productivity created by the invention, the latter also affords many operating advantages, and especially:

improved temperature uniformity of the product;

improved surface quality of the product; and reduced product deformation.

Figures 2, 2A:
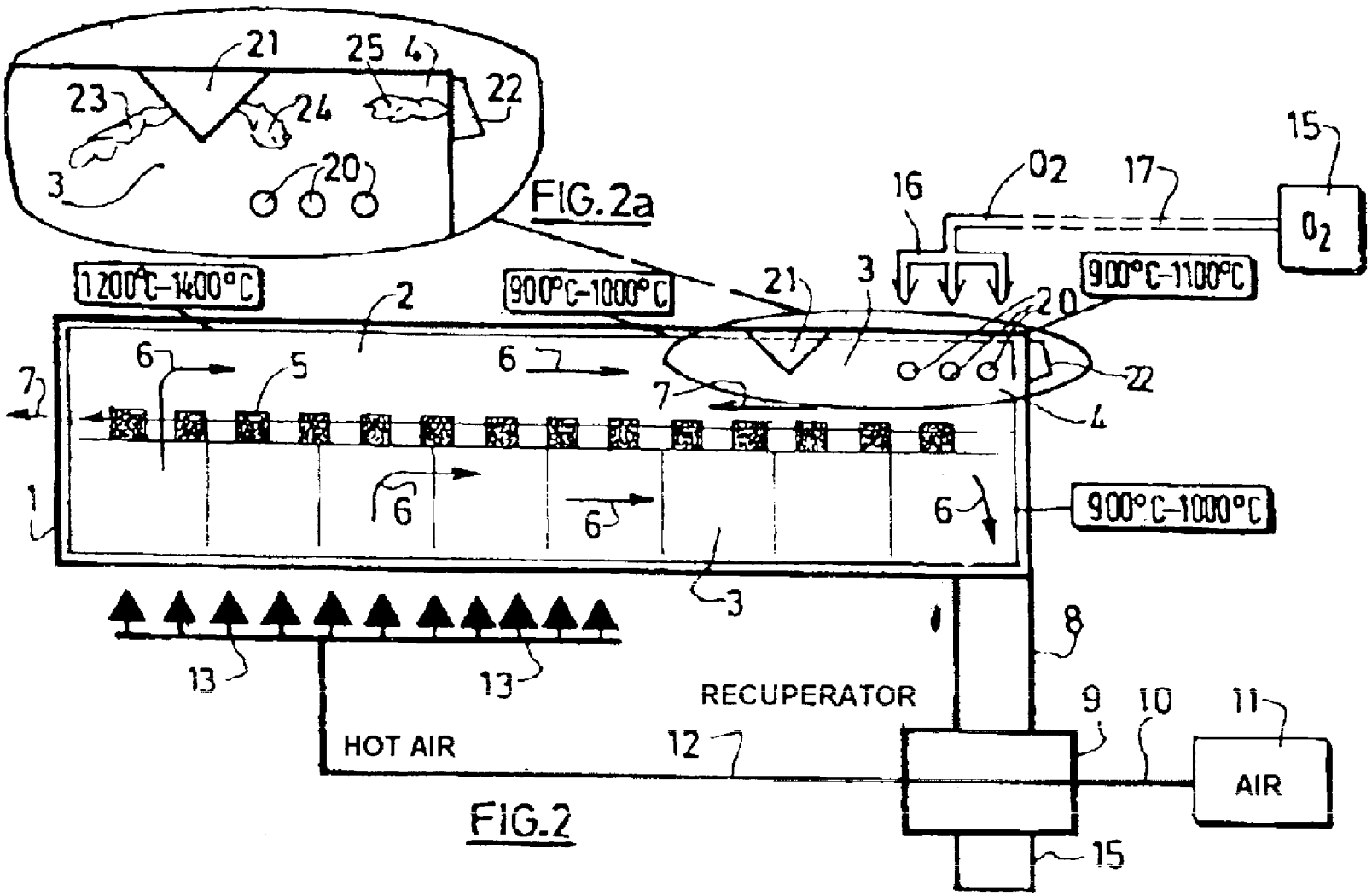
FIG. 2 illustrates the same elements as those in FIG. 1, located schematically above the dead zone 4 are the oxygen intake lines 16, 17, the oxygen coming from the oxygen generator 18, said lines supplying three oxyfuel burners 20 fitted in a side wall of the furnace 1.

The invention will be more clearly understood with the aid of the following illustrative example, implemented in a reheat furnace, in conjunction with FIG. 2, which shows one implementation of the invention.

Oxyfuel burners are fitted in the dead zone of a furnace, the power of these burners representing about 10% of the existing air-fuel power of the furnace.

In the absence of these oxyfuel burners, the temperature in the dead zone of the furnace tested was typically about 650° C. and the temperature at the top of the recuperator was about 820° C. (below 850° C.).

After fitting oxyfuel burners using oxygen of the VSA type (the oxygen supplied for the oxidizer contains more than 88% $O_2$, preferably more than 95 vol % $O_2$, the balance being nitrogen and argon) and a regulating temperature raised to 900° C. in the dead zone, there is no appreciable increase in the temperature at the top of the recuperator. Reprofiling the crown temperature results in a 5% increase in production, for a power increase of 5%.

The same air-fuel configuration would result in a 20° C. increase in the flue gas temperature, which would not be compatible with completely safe operation of the recuperator (the maximum temperature being reached).

According to the invention, when the regulation of temperature to a setpoint value has been raised to 1100° C. in the same so-called "dead" zone (3) before addition of the oxycombustion means), an increase in production of up to 10% and a temperature increase at the recuperator that remains limited to less than 20° C. were noted. This optimized operation makes it possible to achieve the best crown temperature profile of the furnace without causing unnecessary heat loss and, in particular, without any risk to the recuperator.

By comparison, a similar operation but with air-fuel burners added in the "dead" zone causes additional losses, due to this dead zone thus heated, that are four times higher (approximately the air-fuel flue gas/oxyfuel flue gas ratio), the temperature at the top of the recuperator increasing by 100° C.—unauthorized (unsafe) operation of the recuperator.

In FIG. 2, the same elements as those in FIG. 1 bear the same references. Indicated schematically above the dead zone 4 are the oxygen intake lines 16, 17, the oxygen coming from the oxygen generator 15, said lines supplying three oxyfuel burners (20) fitted in a side wall of the furnace 1 (the same burners are also in the wall on the opposite side from the above one).

The indicator 21 represents another possible location for the (supplementary) oxyfuel burners in the crown of the furnace for the supplementary heating of the dead zone 3. The supplementary burners may also be fitted in the scarcely heated zone 4 (part of the zone 3) of the furnace, for example at the place identified by 22 in FIG. 2. FIG. 2*a*, which is an enlargement of part of the dead zone 3 of the furnace, shows the possible location of these various burners 20 and/or 21 and/or 22 and their respective flames 23, 24, firstly in the case of the burners 21 and 25 and secondly in the case of the burner 22. As explained above, it is possible to choose only a single flame, 23 or 24, or possibly both (one being countercurrent with the flue gases and the other cocurrent with the flue gases).

The method according to the invention also offers a furnace operator flexibility in the use of the production means, since the additional or supplementary means may be stopped or powered up (turned off or on) depending on the production/productivity requirements of the furnace.

It follows that the furnace will operate, according to the invention, with a temperature in the flue gas recovery and/or exhaustion zone that may be very appreciably higher than the maximum temperature of the recuperator.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A method of improving the controllability of the temperature profile of a furnace for reheating products, comprising the steps of:

i) introducing said products to be reheated into a first zone of said furnace; and ii) contacting said products with the flue gas generated from a second zone of said furnace, wherein said second zone is located downstream of the first zone, wherein said first zone is fitted with supplementary heating means, wherein said supplementary heating means is capable of delivering at least about 10% and up to about 25% of said initial power requirements, wherein said second zone is fitted with the main heating means capable of generating the total initially installed power requirements, and wherein said method is permanent or temporary.

2. The method according to claim 1, wherein said supplementary heating means generates no more than an additional flue gas amount of up to a volume of about 10% of the total initially installed power requirements of the furnace.

3. The method according to claim 2, wherein said volume is up to about 5%.

4. The method according to claim 2, wherein said supplementary heating means are burners comprising an oxidizer, and wherein said oxidizer comprises more than about 21% by volume oxygen.

5. The method according to claim 4, wherein said volume is more than about 88%.

6. The method according to claim 5, wherein said volume is more than about 95%.

7. The method according to claim 6, wherein said volume is about 100%.

8. The method according to claim 4, wherein said oxidizer further comprises air.

9. The method according to claim 4, wherein said oxidizer further comprises from about 1% to about 10% by volume argon.

10. The method according to claim 4, wherein said oxidizer further comprises from about 0.1% to about 10% by volume nitrogen.

11. The method according to claim 1, wherein said supplementary heating means are provided from at least one source selected from the group consisting of:

a) oxyfuel burners, b) electrical resistance heating elements, and c) regenerative-type burners.

12. The method according to claim 1, wherein said supplementary heating means may be turned on or off depending on the production requirement of the furnace.

13. The method according to claim 1, wherein said method serves at least one function selected from the group consisting of:

a) improves temperature uniformity of the product, b) improves surface quality of the product, and c) reduces product deformation.

14. A furnace apparatus for heating products, comprising i) a first zone equipped with supplementary heating means; and iii) a second zone equipped with main heating elements provided from having at least one air-fuel burner, and wherein said supplementary heating is provided by oxyfuel burners, electrical resistance heating elements, or regenerative-type burners, wherein said supplementary heating means deliver at least about 10% to about 25% of the initial installed power and generate at most an additional 10% by volume of the flue gas above the initial design of said main heating elements.

15. The apparatus according to claim 14, wherein said supplementary heating means are located away from the flue gas discharge duct of the furnace.

16. The apparatus according to claim 14, wherein at least some of said supplementary heating means are located just above the zone where the products enter the furnace.

17. The apparatus according to claim 14, wherein at least some of said supplementary heating means are located just below the zone where the products enter the furnace.

18. The apparatus according to claim 14, wherein at least some of said supplementary heating means are located in a through-recess placed in the crown of said first zone of said furnace.

19. The apparatus according to claim 18, wherein said through-recess is placed downstream of the first zone in relation to the direction in which the reheated products move.

20. The apparatus according to claim 18, wherein said through-recess is placed in the charging end of said furnace.

21. The apparatus according to claim 14, wherein at least some of said supplementary heating means are located laterally.

22. The apparatus according to claim 14, wherein said supplementary heating means may be turned on or off depending on the production requirement on the furnace.

23. The apparatus according to claim 14, wherein said apparatus provides at least one function selected from the group consisting of:

a) improves temperature uniformity of the product, b) improves surface quality of the product, and c) reduces product deformation.

* * * * *